US006572213B2

(12) United States Patent
Valero

(10) Patent No.: US 6,572,213 B2
(45) Date of Patent: Jun. 3, 2003

(54) SYSTEM AND METHOD FOR DETECTING INVISIBLE INK DROPS

(75) Inventor: Jose Luis Valero, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/984,940

(22) Filed: Oct. 31, 2001

(65) Prior Publication Data

US 2003/0081038 A1 May 1, 2003

(51) Int. Cl.[7] ..... B41J 29/393; B41J 29/38
(52) U.S. Cl. ..... 347/19; 347/14
(58) Field of Search ..... 347/19, 15, 43, 347/14, 98, 16, 23, 10, 12, 11, 5, 20, 51; 400/74

(56) References Cited

U.S. PATENT DOCUMENTS 5,980,016 A 11/1999 Nelson et al. ..... 347/19
6,238,112 B1 * 2/2000 Girones et al. ..... 400/74
6,386,669 B1 * 9/2000 Scofield et al. ..... 347/14
6,132,024 A 10/2000 Nelson et al. ..... 347/19
6,325,505 B1 * 12/2001 Walker ..... 347/105

* cited by examiner

*Primary Examiner*—Craig Hallacher
*Assistant Examiner*—Charles W. Stewart, Jr.

(57) ABSTRACT

The presence of invisible ink drops may be relatively easily detected on a print medium by detecting the changes in specular reflection between the print medium and the print medium upon which invisible ink drops are located. An optical sensor having a detector for capturing diffuse reflections and a detector for capturing specular reflections may be implemented to detect the presence of both sufficiently colored ink drops as well as invisible ink drops. In one respect, the location of the detected invisible inks may be utilized to determine whether an ink ejection element that fired the drops of invisible inks is offset or misaligned. In another respect, the drop size of the ink drops may be detected to determine the health of the nozzles. In this regard, the method of detecting the presence of invisible ink drops may be implemented as a routine or sub-routine to determine ink ejection element alignment, apply a positional calibration of the ink ejection element, and apply a printing mask.

21 Claims, 6 Drawing Sheets

SYSTEM AND METHOD FOR DETECTING INVISIBLE INK DROPS

FIELD OF THE INVENTION

This invention relates generally to printing devices. More specifically, the present invention relates to the detection of invisible ink applied on a print medium.

BACKGROUND OF THE INVENTION

Printing mechanisms, e.g., printers, plotters, photocopiers, facsimile machines, etc., are often implemented to record information, e.g., text or graphics, on recording media such as paper, fabric, textile, and the like. In performing recording operations, marking implements, e.g., printheads, are often used to apply an ink onto the recording media.

The positional accuracy of the marking implements as well as the nominal inking density and/or flow volume, are significant factors in assuring that the ink is applied onto the recording media in a desired manner. In an effort to maintain these factors within predetermined operating conditions, conventional printing mechanisms may perform calibration operations. These calibration operations typically entail the printing of a test pattern by the marking implements along with a scanning operation of the test pattern.

The scanning operation is typically performed with optical sensors having a light emitting diode (LED) that emits a light over the test pattern and a sensor that detects the light reflected from the test pattern. Based upon the reflected light patterns, characteristics of the applied ink such as placement and drop volume, may be determined. Once these characteristics are determined, the marking implements may be calibrated, e.g., adjusting the firing time of ink from the marking implements during printing passes to more accurately position the ink on the recording medium, varying the amount of ink fired from the marking implements, etc.

Conventional optical sensors may be unable to detect colors that are similar to the recording medium, e.g., yellow on white paper, etc. Moreover, conventional optical sensors are typically unable to detect inks having no color, i.e., "invisible ink". Throughout the present disclosure, "invisible ink" generally refers to observations of ink coated onto some particular printing medium under some particular illumination. In addition, "invisible inks" are inks having colors that do not provide adequate contrast, relative to the recording medium background without the color, for adequately reliable detection by the sensor. It should be understood that ordinarily, invisible ink may be visible to the normal human eye, even though the sensing system may be unable to distinguish it well from the print medium background. In addition, some applications may make use of ink that is invisible to the human eye as well.

In one respect, conventional optical sensors may be unable to distinguish between these invisible inks and the recording medium color, which may be white or some other light color. In these situations, it is generally known to print a relatively dark colored ink, e.g., magenta ink, in an area fill. The area fill containing the colored ink is printed upon with the invisible ink, which mixes with the colored ink. The resultant mixture causes the colored ink to change its color, e.g., renders the colored ink to become brighter. A standard optical sensor may then be implemented to detect the differences in the color of the colored ink in the fill area to determine where the invisible ink has been applied.

One problem associated with the above-described technique is that it requires the use of the dark colored ink to determine the locations of the invisible ink applications. This generally results in a waste of the dark colored ink as well as the certain portions of the print medium where the dark colored ink is applied.

Alternatively, it is generally known to add a so-called "marker" element to the invisible ink. The marker typically consists of an ink that may comprise a color that is invisible to the human eye. However, systems employing this type of marker element are relatively complex and are thus associated with higher operating costs. In addition, they require the use of additional hardware, e.g., additional optical sensors that are capable of detecting this type of marker.

SUMMARY OF THE INVENTION

According to an aspect, the present invention pertains to a method for detecting invisible ink drops on a print medium. In the method, one or more drops of the invisible ink is fired from at least one nozzle of an ink ejection element onto a first intended location on the print medium. An area encompassing the first intended location is illuminated and changes in light reflectance are detected around the area. In addition, an actual location of the one or more invisible ink drops is determined in response to detected changes in the light reflectance.

According to another aspect, the present invention relates to a system for determining presence of invisible ink drops on a print medium. The system includes an optical scanner operable to detect specular reflections from the print medium and locations on the print medium containing the invisible ink drops. The system also includes a controller operable to detect changes in the specular reflections to determine the locations of the invisible ink drops.

According to a further aspect, the present invention relates to a method for detecting invisible ink drops on a print medium. In the method, an optical detector is scanned over the print medium in an area believed to contain the invisible ink drops. In addition, changes in reflectance of the print medium are detected in the area.

In comparison to known printing mechanisms and techniques, certain embodiments of the invention are capable of achieving certain aspects, including, relatively inexpensive and simple manner of detecting the presence of invisible ink drops applied on a print medium, a system and method for detecting invisible ink drops without requiring the use of a marker, and the ability to print invisible ink drop test patterns on various sections of the print media other than waste areas. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

According to an exemplary embodiment of the present invention, the presence of invisible inks may be relatively easily detected on a print medium. In one respect, the location of the detected invisible inks may be utilized to determine whether a printhead that fired the drops of invisible inks is offset or misaligned. In this regard, the exemplary embodiment may be implemented as a routine or sub-routine to determine printhead alignment.

By way of example, invisible inks may comprise so-called "fixers". Fixers, as the name implies, generally refer to liquid materials that may be applied beneath a colored ink drop, e.g., pre-coats, and liquid materials that may be applied over a colored ink drop, e.g., post-coats. Fixers may be utilized to increase the adhesion of the colored ink drops onto print medium. In addition, fixers may be utilized to control the dry time of colored ink drops and/or the light fastness of colored ink drops. Moreover, invisible inks may also comprise those elements described hereinabove in the Background section of the present disclosure.

By operation of the present invention, invisible ink drops applied onto a print medium may be detected without requiring the need for relatively expensive optical equipment. In addition, the invisible ink drops may be detected without requiring the printing of colored ink.

Figure 1:
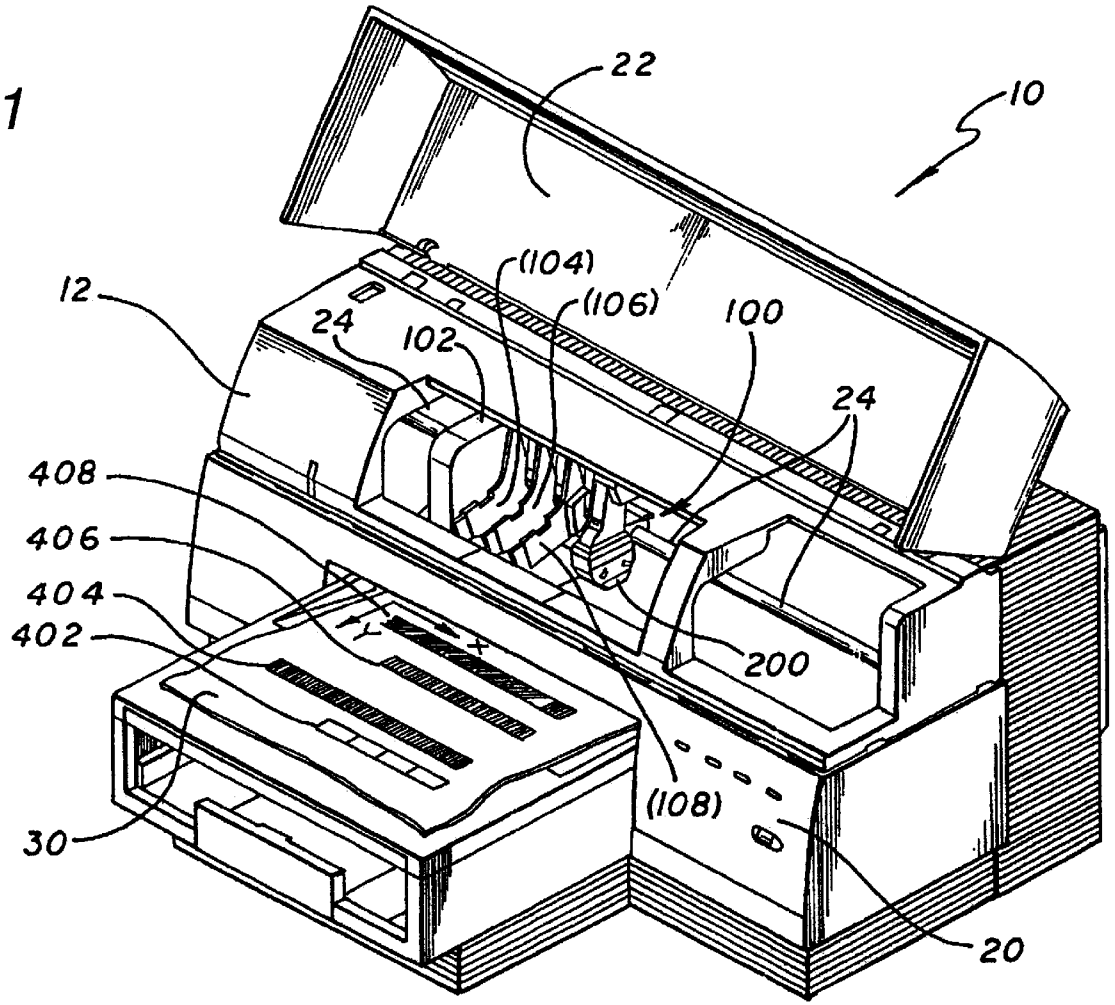
FIG. 1 is a perspective view of an inkjet desktop printer incorporating or constituting a preferred embodiment of the present invention.
Figure 1A:
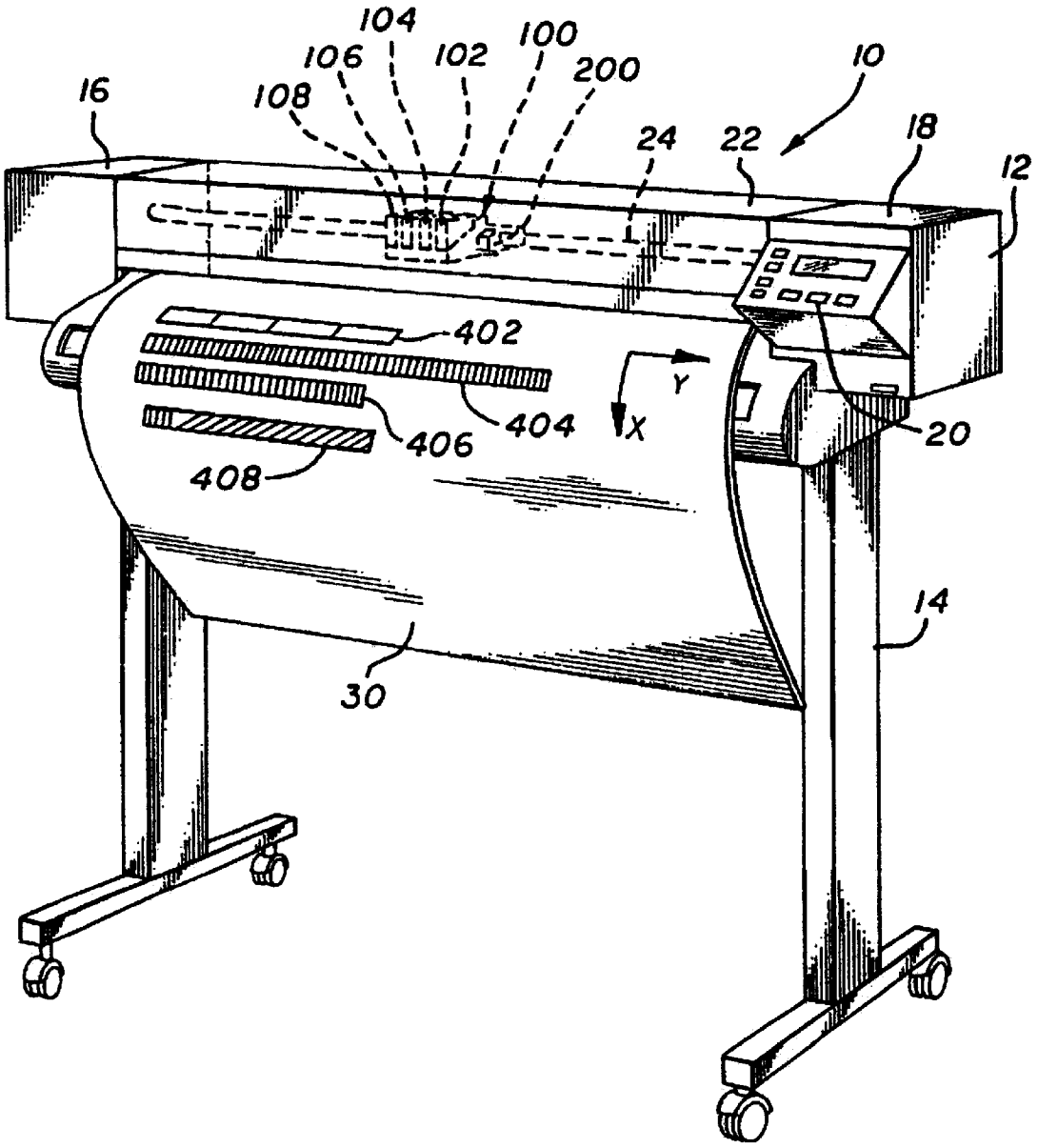
FIG. 1*a* is a perspective view of a large-format printer/plotter likewise incorporating or constituting the FIG. 1 embodiment of the present invention with corresponding components having like reference numerals.

As FIGS. 1 and 1*a* indicate, preferred embodiments of the invention are advantageously incorporated into an automatic printer, as for instance a thermal-inkjet desktop printer or large-format plotter respectively. In addition, preferred embodiment of the invention may be incorporated into a piezo-electric desktop printer or large-form plotter. The printer or plotter 10 includes a housing 12, with a control panel 20.

As to the plotter of FIG. 1*a*, the working parts may be mounted on a stand 14; and the housing 12 has left and right drive-mechanism enclosures 16 and 18. The control panel 20 is mounted on the right enclosure 18.

A carriage assembly 100 (which for the large-format plotter of FIG. 1*a* is illustrated in phantom under a transparent cover 22), is adapted for reciprocal motion along a slider rod or carriage bar 24 (also in phantom for the plotter). The position of the carriage assembly 100 in a horizontal or carriage-scan axis is determined by a carriage positioning mechanism (not shown) with respect to an encoder strip (not shown), as is known to those skilled in the art.

Preferably, the carriage 100 includes four or more stalls or bays for automatic marking implements such as inkjet pens that print with ink of different colors. These are for example, black ink and three chromatic-primary (e. g. yellow, magenta and cyan) inks, respectively. However, one or more of these pens may be configured to print with invisible ink. Alternatively, one or more additional marking implements may be positioned on the carriage 100 to print with invisible ink.

FIG. 1 shows, for the desktop printer, a single representative pen 102—and the remaining three empty bays marked with reference numbers in parentheses thus: (104), (106) and (108). For the large-format plotter, FIG. 1*a* shows all four pens 102, 104, 106, and 108.

In both the printer and the plotter, as the carriage assembly 100 translates relative to the medium 30 along the x and y axes, selected nozzles in all four thermal-inkjet cartridge pens are activated. In this way, ink may be applied to the medium 30.

The colors from the three chromatic-color inkjet pens are typically used in subtractive combinations by overprinting to obtain secondary colors; and in additive combinations by adjacent printing to obtain other colors.

Figure 2:
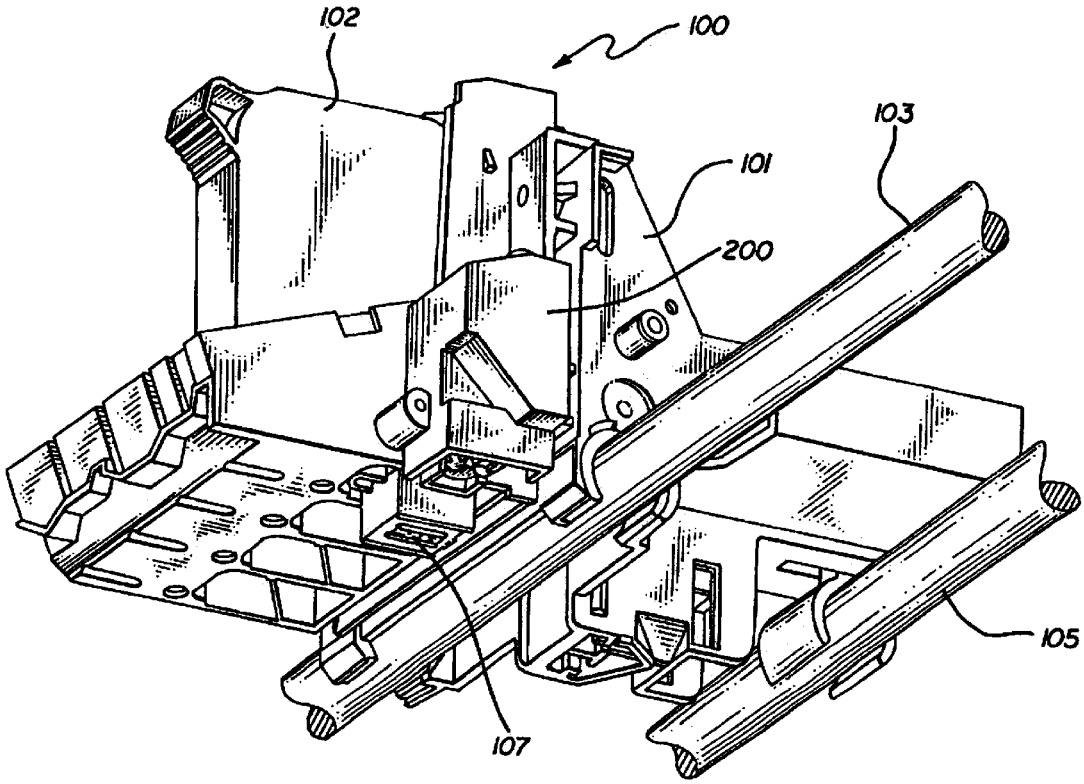
FIG. 2 is a perspective view, taken from below and to the right, of the carriage assembly of FIG. 1*a*, showing the sensor module generally.

The carriage assembly 100 includes a carriage 101 (FIG. 2) adapted for reciprocal motion on a slider bar or carriage rod 103. For the much greater transverse span in the large-format plotter, there are a front slider rod or carriage bar 103 and a like rear rod/bar 105. A representative first pen cartridge 102 is shown mounted in a first stall of the carriage 101.

Considerable additional information about a carriage drive and control system that is suitable for integration with the present invention appears in U.S. Pat. No. 5,600,350 issued to Cobbs et al. and assigned to the HEWLETT-PACKARD Co. The disclosure contained in that patent is hereby incorporated by reference in its entirety.

A print medium 30, such as paper, is positioned along a vertical or print-medium-advance axis by a medium-advance drive mechanism (not shown). As is common in the art and as mentioned earlier, for desktop printers the carriage-scan axis is denoted the x axis and the medium-advance axis is denoted the y axis; and for large-format plotters conversely.

Print-medium and carriage position data go to a processor on a circuit board that is preferably on the carriage assembly 100, for the large plotter, or elsewhere in the chassis for the desktop model. The carriage assembly 100 also may hold circuitry required for interface to firing circuits (including firing resistors) in the pens.

Also mounted to the carriage assembly 100 is a sensor module 200 (e.g., electrooptical sensor). Note that the inkjet nozzles 107 (FIG. 2) of the representative pen 102, and indeed of each pen, are in line with the sensor module 200.

Full-color printing and plotting require that the colors from the individual pens be precisely applied to the printing medium. This requires substantially precise alignment of the carriage assembly. Unfortunately, paper slippage, paper skew, and mechanical misalignment of the pens in conventional inkjet printer/plotters result in offsets along both the medium- or paper-advance axis and the scan or carriage axis.

Preferably, a group of test patterns 402, 404, 406, 408 is generated (by activation of selected nozzles in selected pens while the carriage scans across the medium) whenever any of the cartridges is disturbed, for example, just after a marking implement (e.g., pen) has been replaced, in response to a user request, or due to a scheduled action (e.g., according to a pen maintenance schedule). In addition, at least one of the test patterns 402–408 may have been printed with invisible ink. The test patterns are then read by scanning the sensor 200 over them, and analyzing the resulting waveforms.

The sensor module 200 optically senses the test pattern and provides electrical signals to the system processor, indicative of the registration of the portions of the pattern produced by the different marking implements respectively.

Figure 3:
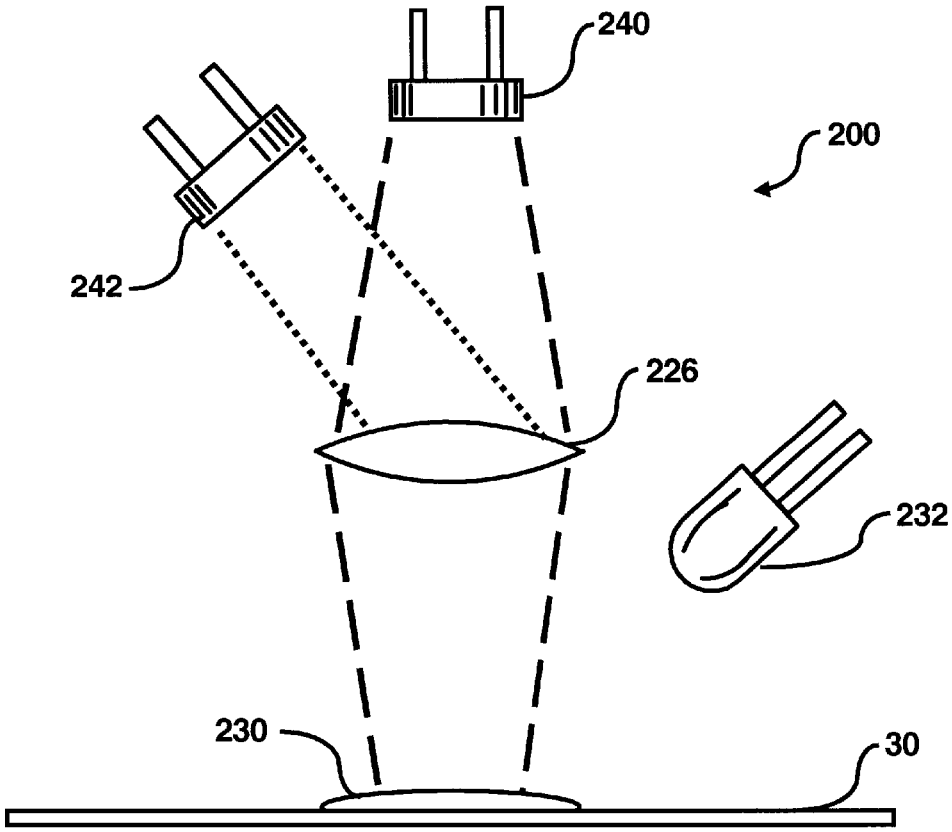
FIG. 3 is a highly schematic diagram of the optical elements in the sensor module of the present invention.

FIG. 3 shows a representative sensor module 200 utilized in the two preferred embodiments of the lower-numbered drawings. Each sensor module 200 includes at least one light-emitting diode (LED) 232, a lens 226 (or if preferred a more-complicated focal system with a second lens, such as that shown by Cobbs et al.) fixed relative to a pair of photodetectors 240, 242 (light-to-voltage converters (LTVs)).

The LED 232 is mounted to the sensor module 200, at an angle as shown, along with an amplifier and other circuit elements (not shown). The sensor module 200 functions by projecting illumination from the LED 232 at an angle onto the paper. The light strikes the print medium 30 at the intersection of the optical axis of the lens 226 (e.g., a central diffuse-reflectance imaging lens). The reflected illumination produces a diffusely reflected beam emanating in many directions and a reflection in the specular direction. The reflected illumination is imaged onto the two LTVs 240 and 242. A central LTV 240 captures the diffuse component of the reflectance and an outside LTV 242 captures the specular component of the reflectance. The source of illumination, the magnitude of the detected signals and the relationship between the reflectance components provides the information needed to perform the high-level sensor functions.

The detection of the diffuse reflectance by the central LTV 240 is utilized to determine the presence of the primary inks (e.g., black, magenta, light magenta, cyan, light cyan and yellow). The specular measurement is implemented to determine the relative surface properties of the media (i.e., gloss). The specular measurement may thus be implemented to detect changes in the surface properties of the media, e.g., various changes in surface properties on the media may indicate presence of invisible ink drops. In this respect, the light-emitting diode 232 and LTVs 240 and 242 form a sensing system which can discriminate between the presence and the absence of ink, both visible and invisible.

Associated circuitry (shown and discussed in the U.S. Pat. No. 5,796,414, issued to Sievert et al. and assigned to the HEWLETT-PACKARD CO., the disclosure of which is hereby incorporated by reference in its entirety) stores these signals, averages them as mentioned above, and examines their phase relationships to determine the alignments of the pens for each direction of movement. Fourier-transform methods, of either the "fast" or "discrete" type, may facilitate this process.

More specifically, the Fourier transform of the data is determined and the phase then extracted from the transform by comparison of its real and imaginary parts (i. e., sine and cosine components). Preferably, the system is programmed to find just a single term of the discrete Fourier transform, corresponding to the fundamental; the arctangent of the ratio of imaginary and real parts for this term then reveals the phase for the calibration process.

Preferably the system corrects for carriage-axis misalignment—and print-medium-axis misalignment—and can be used to correct for offsets due to speed and curvature as well. Further details of these options are discussed at length in the Cobbs et al. documents and so need not be repeated here.

The Cobbs and Sievert documents further describe, in detail, correction for deviations in the carriage-scan axis, and also correction of offsets in the printing-medium-advance axis and between pens.

Offsets between pens, along the medium-advance axis, can be corrected by selecting certain nozzles for activation, as described by Cobbs et al., or by masking the data as between swaths of the marking implements as mentioned by Sievert et al.

In addition, the health of the nozzles may be assessed by operation of the test pattern scanning operation. For example, it may determined whether certain of the nozzles are misfiring, or failing to fire any ink drops. If it is determined that certain of the nozzles are not properly operating, a printing mask may be implemented, e.g., another nozzle may be used in place of the improperly operating nozzle, to thereby prevent substantial impact on print quality. In addition, if the number of improperly operating nozzles reaches a threshold level, e.g., as defined by the selected printmode, an intervening action may be triggered, e.g., a servicing operation consisting of spitting, wiping, etc.). Furthermore, if the number of improperly operating nozzles reaches another threshold level, the printhead containing those nozzles may require replacement.

Figure 4:
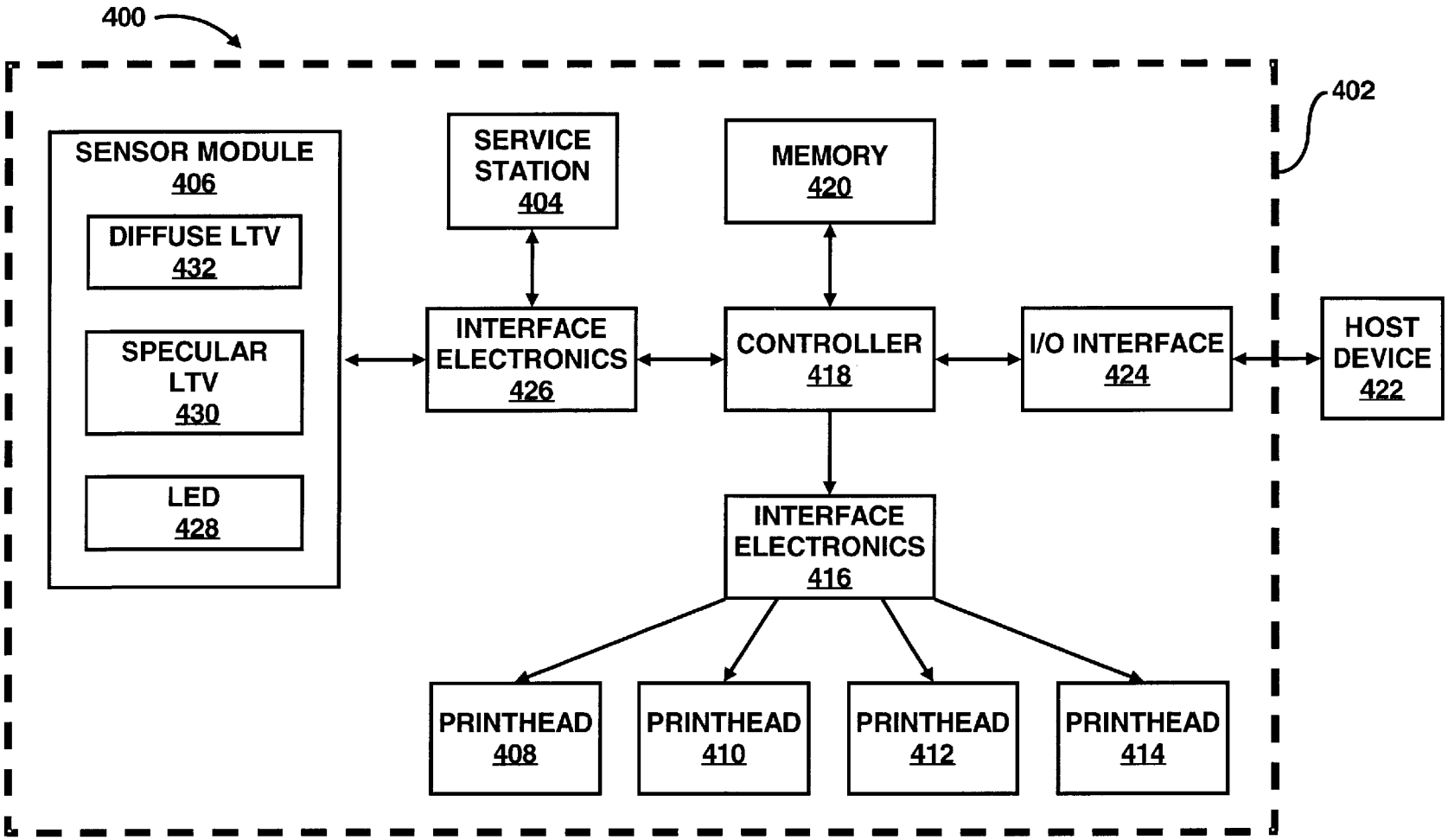
FIG. 4 is an exemplary block diagram of a printing mechanism in accordance with an embodiment of the present invention.

Referring to FIG. 4, there is illustrated an exemplary block diagram 400 of a printer 402 in accordance with the principles of the present invention. The following description of the block diagram 400 illustrates one manner in which a printer 402 having a service station 404, a sensor module 406, and a plurality of printheads 408–414 may be operated in accordance with an exemplary embodiment of the invention. In this respect, it is to be understood that the following description of the block diagram 400 is but one manner of a variety of different manners in which such a printer 402 may be operated.

The printer 402 may include interface electronics 416. The interface electronics 416 may be configured to provide an interface between a controller 418 of the printer 402 and the components for moving the printheads 408–414, e.g., a carriage, belt and pulley system (not shown), etc. The interface electronics 416 may also include, for example, circuits for advancing the print medium, firing individual nozzles of the printheads 408–414, and the like.

The controller 418 may be configured to provide control logic for the printer 402, which provides the functionality for the printer. In this respect, the controller 418 may possess a microprocessor, a micro-controller, an application specific integrated circuit, and the like. The controller 418 may be interfaced with a memory 420 configured to provide storage of a computer software that provides the functionality of the printer 402 and may be executed by the controller. The memory 420 may also be configured to provide a temporary storage area for data/file received by the printer 402 from a host device 422, such as a computer, server, workstation, and the like. The memory 420 may be implemented as a combination of volatile and non-volatile memory, such as dynamic random access memory ("RAM"), EEPROM, flash memory, and the like. It is also within the purview of the present invention that the memory 420 may be included in the host device 422. In addition, the host device 422 may be incorporated with the printer 402 as an integral mechanism. In this respect, the printer 402 may be operable to directly receive files from a user, the internet, and the like.

The controller 418 may further be interfaced with an I/O interface 424 configured to provide a communication channel between the host device 422 and the controller 418. The I/O interface 424 may conform to protocols such as RS-232, parallel, small computer system interface, Universal Serial Bus, etc.

In addition, the controller 418 may be interfaced with the service station 404 and sensor module 406 through interface electronics 426. The interface electronics 426 may be configured to provide an interface between the controller 418 of the printer 402 and the components for operating the service station 404 and the sensor module 406, e.g., performing wiping functions on the printheads 408–414, capping the nozzles of the printheads, activating and deactivating the components of the sensor module 406, etc. In this respect, the controller 418 may be configured to control the operations of the service station 404 (e.g., wiping, capping, and the like) as well as the sensor module 406 (e.g., timing of the test pattern detections and the like).

The sensor module 406 includes at least one light-emitting diode (LED) 428, a lens (or a more-complicated focal system with a second lens (not shown)), and a pair of photodetectors 430 and 432 (light-to-voltage converters (LTVs)). The LTVs 430 and 432 are designed to detect diffuse and specular reflections, respectively, as described hereinabove.

Although FIG. 4 illustrates four printheads 408–414, one sensor module 406 and one service station 404, it should be understood that any reasonably suitable numbers of these components may be implemented in the printer 402 without departing from the scope and spirit of the present invention.

Figure 5:
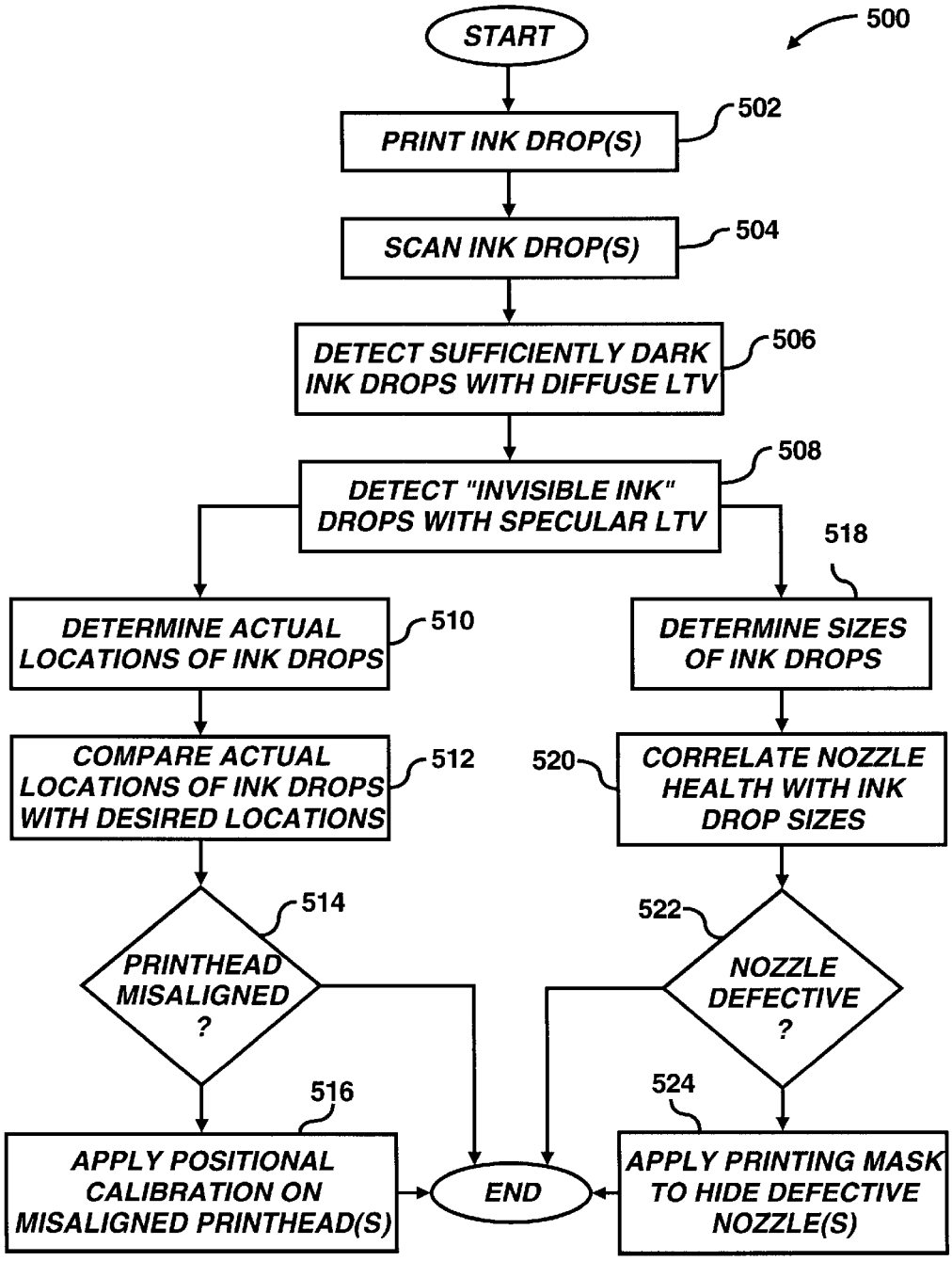
FIG. 5 is an exemplary flow diagram of a manner in which an embodiment of the present invention may be practiced.

Referring now to FIG. 5, there is illustrated an exemplary flow diagram of a method 500 of a manner in which an embodiment of the present invention may be practiced. The following description of the method 500 is made with reference to the block diagram illustrated in FIG. 4, and thus makes reference to the elements illustrated therein. It is to be understood that the steps illustrated in the method 500 may be contained as a routine or sub-routine in any desired computer accessible medium. In addition, the method 500 may be performed by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 4 to the controller 418 as performing certain printer functions, it is to be understood that those functions may be performed by any electronic device capable of executing the above-described functions.

At step 502, the printer 402 may print one or more ink drops, e.g., fire drops of ink in desired patterns (e.g., locations) onto the print medium 30, with one or more of the printheads 408–414. The instruction to print the ink drop(s) may be received from a variety of sources. The sources may include, for example, the host device 422, the memory 420, the Internet, the printer 402, etc. The instruction to print may include the type of test pattern to be printed including, for example, the speed of the printhead.

At step 504, the controller 418 operates the sensor module 406 to scan over the ink drop(s), as well as various areas on the print medium around the ink drop(s). As described hereinabove, the sensor module 406 generally comprises a specular LTV 430 and a diffuse LTV 432, as well as various other components for operating the sensor module 406 (not shown).

As also described hereinabove, the scanning of the ink drop(s) is generally accomplished by illuminating the area of the ink drop(s), e.g., the area on the print medium where the test pattern has been printed, and detecting the color, position and/or size of the ink drops in the test pattern area. The color, position and/or size of the ink drops may be determined by virtue of the differences in reflectance in the print medium between those areas that contain the ink drops and those that do not.

Those ink drops having colors that provide sufficient contrast with the print medium 30 may be detected by the diffuse LTV 432 as indicated at step 506. Moreover, as indicated at step 508, those ink drops that are "invisible" may be detected by the specular LTV 430.

As indicated at step 510, based upon the scan of the ink drop(s), the controller 418 may determine the actual locations and/or sizes of the ink drops. At step 512, the controller 418 compares the detected actual locations of the ink drop(s) with the desired locations of the ink drop(s). By performance of this comparison, and as noted at step 514, the controller 418 may determine whether any of the printheads 408–414 are offset or otherwise misaligned, e.g., the actual location of the ink drop(s) are not the same as the desired locations.

If any of the printheads are determined to be offset or otherwise misaligned, the corrections detailed in the Cobbs and Sievert documents may be implemented by the controller 418 as noted at step 516.

In addition, the health of the nozzles may also be determined. For example, the sizes of the ink drops may be detected at step 518. At step 520, the drop sizes are correlated with the nozzles, e.g., the drop sizes may be used to determine the health of the nozzles. At step 522, the nozzles may be determined as being defective based upon the correlation performed at step 520. If any of the nozzles are determined to be defective, a printing mask may be implemented for those improperly operating nozzles as described hereinabove, as indicated at step 524.

By virtue of certain aspects of the present invention, invisible ink drops fired onto print media may be detected in a relatively simple and inexpensive manner.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for detecting invisible ink drops on a print medium, said method comprising:

firing one or more drops of said invisible ink from at least one nozzle of an ink ejection element onto a first intended location on said print medium;

illuminating an area encompassing said first intended location to thereby reflect light off said first intended location;

detecting for changes in light reflectance around the area encompassing said first intended location; and determining an actual location of said one or more invisible ink drops in response to detected changes in the light reflectance.

2. The method according to claim 1, further comprising:

comparing said actual location of said one or more invisible ink drops to said first intended location.

3. The method according to claim 2, further comprising:

returning a signal indicating said ink ejection element is misaligned in response to said actual location not being substantially near said first intended location.

4. The method according to claim 3, further comprising:

applying a positional calibration of said ink ejecting element in response to receipt of said signal indicating said ink ejection element is misaligned.

5. The method according to claim 1, wherein said step of detecting changes in light reflectance comprises:

sensing the reflectance of said print medium in said area encompassing said first intended location and the reflectance of said print medium containing said invisible ink.

6. The method according to claim 5, further comprising:

detecting specular reflectance from said area encompassing said first intended location and said actual location of said invisible ink drops.

7. The method according to claim 5, further comprising:

detecting both specular reflectance and diffuse reflectance from said area encompassing said first intended location and said actual location of said invisible ink drops.

8. The method according to claim 7, further comprising:

determining presence of colored inks in response to said diffuse reflectance detection; and determining presence of invisible inks in response to said specular reflectance detection.

9. The method according to claim 1, further comprising:

firing one or more drops of colored inks onto a second intended location on said print medium;

illuminating said area encompassing said second intended location; and scanning for diffuse reflection around an area encompassing said second intended location; and determining an actual location of said one or more colored ink drops in response to detected diffuse reflections.

10. The method according to claim 1, wherein said step of firing one or more drops of said invisible ink onto said print medium comprises the firing of only said one or more drops of said invisible ink.

11. The method according to claim 1, further comprising:

determining drop sizes of said one or more invisible ink drops in response to said detected changes in the light reflectance.

12. The method according to claim 11, further comprising:

determining the health of said nozzles in response to said determined drop sizes.

13. A system for determining presence of invisible ink drops on a print medium, the system comprising:

an optical scanner operable to detect specular reflections from said print medium and locations on said print medium containing said invisible ink drops; and a controller operable to detect changes in the specular reflections to determine said locations of said invisible ink drops.

14. The system according to claim 13, wherein said optical scanner is further operable to detect diffuse reflections.

15. The system according to claim 14, wherein said optical scanner comprises a first detector configured to capture diffuse reflections and a second detector configured to capture specular reflections from said print medium and said invisible ink drops.

16. The system according to claim 13, wherein said controller is operable to determine misalignments in said at least one ink ejection element based upon said detected specular reflections from said deposited invisible ink drops on said print medium.

17. The system according to claim 16, wherein said controller is operable to apply a positional calibration of at least one ink ejection element in response to a determination of said at least one ink ejection element being misaligned.

18. The system according to claim 13, wherein said controller is operable to determine drop sizes of said invisible ink drops based upon said detected specular reflections.

19. The system according to claim 18, wherein said controller is operable to determine the health of said nozzles based upon said determined drop sizes.

20. A method for detecting invisible ink drops on a print medium, said method comprising:

scanning an optical detector over the print medium in an area believed to contain said invisible ink drops; and detecting for changes in reflectance of said print medium in said area.

21. The method according to claim 20, wherein said step of detecting for changes in reflectance comprises detecting specular reflectance of said print medium.

* * * * *